US005896871A

United States Patent [19]

Larsen

[11] Patent Number: 5,896,871

[45] Date of Patent: Apr. 27, 1999

[54] METHOD FOR WASHING THE INTERIOR SURFACES OF TANKS AND CONTAINERS

[75] Inventor: Leif Steen Larsen, Hedehusene, Denmark

[73] Assignee: Toftejorg Technology A/S, Denmark

[21] Appl. No.: 08/990,557

[22] Filed: Dec. 15, 1997

Related U.S. Application Data

[63] Continuation-in-part of application No. PCT/DK96/00233, May 31, 1996, abandoned.

[30] Foreign Application Priority Data

Jun. 15, 1995 [DK] Denmark ..... 684/95

[51] Int. Cl.[6] ..... B08B 9/093

[52] U.S. Cl. ..... 134/22.1; 134/22.18; 134/167 R; 239/227

[58] Field of Search ..... 134/18, 22.1, 22.18, 134/167 R, 168 R; 239/227

[56] References Cited

U.S. PATENT DOCUMENTS

| | | | |
|---|---|---|---|
| 3,472,451 | 10/1969 | Orem et al. | 239/227 |
| 3,874,594 | 4/1975 | Hatley | 239/227 |
| 3,878,857 | 4/1975 | Heibo | 239/227 X |
| 4,515,312 | 5/1985 | Manabe et al. | 238/227 |
| 4,859,249 | 8/1989 | Valentini | 134/22.18 |
| 5,279,675 | 1/1994 | Verbeek | 134/22.1 |

*Primary Examiner*—Jill Warden
*Assistant Examiner*—Saeed Chaudhry
*Attorney, Agent, or Firm*—Thomas R. Vigil

[57] ABSTRACT

A method for washing the interior surfaces of tanks with a washing head is provided with a nozzle (28) which ejects a liquid beam and which is rotatable about a first (11) and a second (34) axis whereby the nozzle is allowed to cover a two-dimensional solid angle. The washing head is controlled in such a manner that for an entire revolution about the first axis, the nozzle performs a small rotation about the second axis, and that over a number of revolutions about the first axis the nozzle follows a path which covers the entire a solid angle. The drive mechanism for rotating the washing head is arranged externally of the conduits carrying washing liquid in order to avoid loss of washing pressure and wear of the drive mechanism. According to the invention the movement of the nozzle along the defined path is monitored and the result of the monitoring is utilised to control the energy density of the beam in order that it is reduced when the beam is directed at the zones which do not require the maximum energy.

8 Claims, 6 Drawing Sheets

FIG. 6
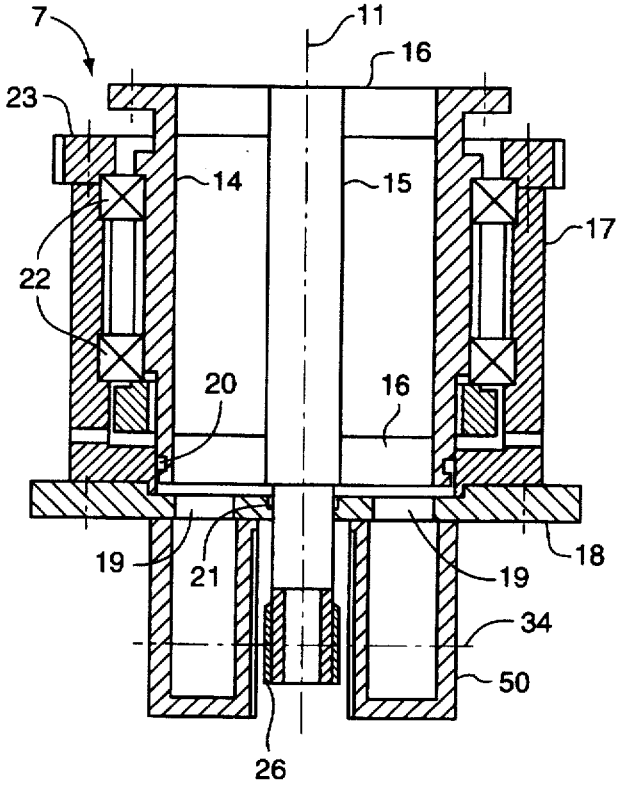
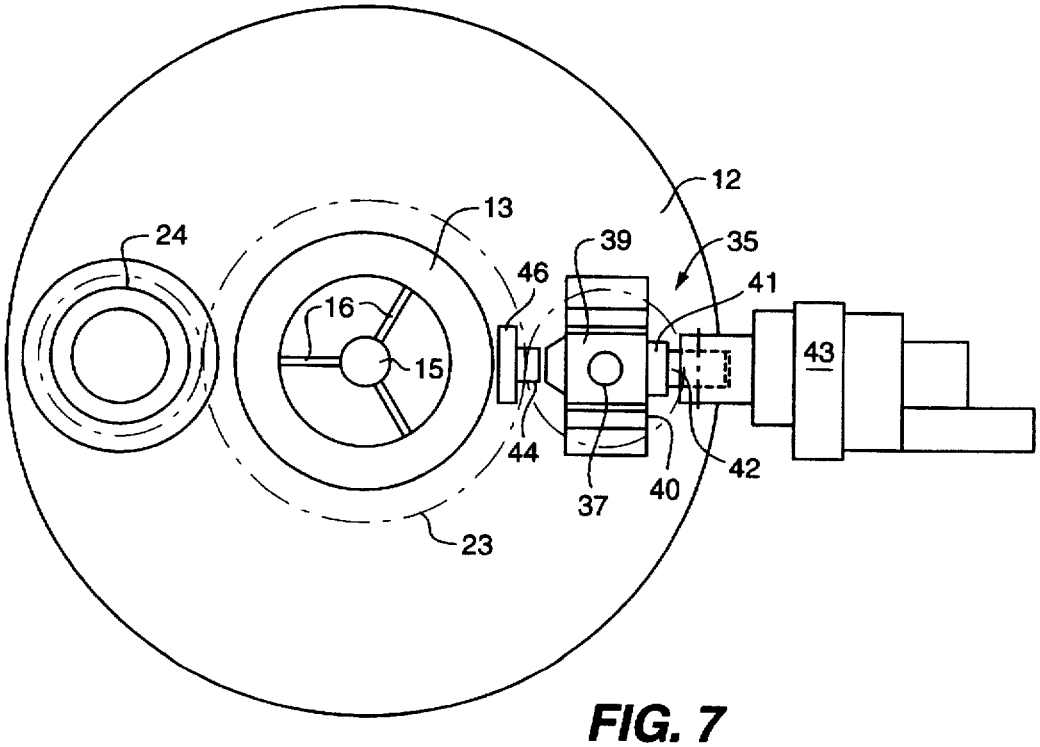
FIG. 7

METHOD FOR WASHING THE INTERIOR SURFACES OF TANKS AND CONTAINERS

CROSS-REFERENCE TO RELATED APPLICATIONS

This is a continuation-in-part of international application PCT/DK96/00233, with an international filing date of May 31, 1996, now abandoned.

This application is based on application No. 0684/95 filed in Denmark on Jun. 15, 1995, the contents of which are incorporated herein by this reference.

BACKGROUND OF THE INVENTION

1. Field of the Invention

The present invention relates to a method and an apparatus for washing the interior surfaces of tanks and containers. In particular, the invention relates to the cleaning of containers wherein a jet or a beam of cleaning fluid is ejected under high pressure and at a high velocity, which beam impinges the surfaces to be treated, and wherein the beams are controlled in particular with respect to their orientations with a view to cleaning or the like of predetermined surfaces interiorly of the container.

The cleaning by washing may be obtained through different effects, such as the dissolving effect of the washing fluid on impurities, loosening of dirt by the impact of the washing liquid or possibly of the cleaning particles slurried therein, or by heating of the impurities to render them more fluent or easier to dissolve through the influence of hot washing fluid.

In general, it is the object of the washing fluid to loosen adhering impurities and to transport them out of the tank, following which they may be processed, separated and/or disposed of in a controlled manner. Typical washing fluids include water with or without chemicals, oil products, solvents and/or mixtures thereof.

2. The Prior Art

U.S. Pat. No. 5,591,272 incorporated herein by reference discloses a method by which washing fluid is sampled from the usual contents of the tank, the washing medium optionally being roughly purified and heated to make it less viscous prior to its utilisation in the washing procedure.

Various washing heads are known on the market which are provided with nozzles and adapted to be installed in a fixed position and pivoted automatically to make the washing beam cover a specified solid angle during the washing process (corresponding to a surface section on a spherical surface) thereby ensuring that any point within this angle is covered with a guaranteed minimum intensity, and said units controlling the nozzles in accordance with various preprogrammed patterns so as to ensure that the distribution of the washing intensities in different directions are known. It is necessary for the nozzles to have degrees of freedom to pivot in two dimensions, i.e. in practice they should be allowed to pivot about two orthogonal axes. However, if the drive wheels for pivoting about the two axes are to be constructed in a mechanically uncomplicated manner, i.e. with simple mechanical gears, it is not readily feasible to provide uniform washing intensities in all directions in space seen from the nozzle's position. Thus, it is necessary to tolerate that usually some areas are more intensely washed than need be, if it is a priority to maintain a minimum intensity in certain other areas.

During cleaning of tanks the impurities to be cleaned out need not necessarily be uniformly distributed across the surfaces. In many instances a sedimentation has occurred which means that the tank floor may be covered with a thick layer of material which is difficult to remove. Another area where there may be a propensity to form solid deposits is the zone on the tank wall slightly above a liquid surface which has prevailed for an extended period of time in the tank where there may be a propensity to cake formation over time. In this case it is desired to direct a particularly high cleaning intensity towards the surfaces where the impurities have a particular tendency to stick or perhaps are particularly difficult to remove whereas other areas need not be subjected to an equally intense cleaning procedure.

In general, the tank geometry and the distribution of impurities relative to the positions in which the pivotable nozzles may be installed makes it difficult to match the beam pattern of the washing heads, and therefore general purpose washing heads with broad-sweeping beam patterns capable of covering all the directions to be reached, and washing for such extended period of time and with such intensity that in reality a substantial excess consumption of washing liquid occurs over a large portion of the tank are often resorted to. This excess consumption of washing liquid represents a poor exploitation of time, an increased energy cost, possibly an undesired wear on the tank interior, and it involves an increased cost of purifying the waste liquid which is discharged in larger quantities than desired.

U.S. Pat. 3,874,594 describes a washing unit including a nozzle arranged to be pivoted 360° about a vertical axis and an angle about a horizontal axis to allow the washing beam pattern to cover a spherical surface, a rotatable head being driven by a shaft rotating centrally in a vertical support pipe, the rotatable head housing a worm gear arrangement causing a reduced speed rotation of the nozzle about the horizontal axis. The worm is free to slide axially a short distance equivalent to one half of the pitch of the worm in order that the nozzle may describe a helical pattern upon several revolution of the shaft, and upon reversing the direction of rotation, a non-coincident helical pattern during reversed rotation. The rotation of the shaft is driven by a turbine equipped with a gear box with changeable gears for reversal of the rotation. A lead screw mechanism in the gear box is connected to a cam mechanism associated with a lever adapted to control the pitch angle of the blades in the turbine.

The whole set-up looks exceedingly complicated comprising a great number of parts which must be matched very accurately and which indeed make it questionable whether this apparatus could be implemented in a practical version capable of actually operating as intended. The great number of parts, bearings and seals in contact with the washing medium represents a substantial complication, bearing in mind that the washing medium might include corrosive or aggressive ingredients and bearing in mind that any leakage in the area outside the tank are unacceptable in case oil or other inflammable liquids are used for washing medium. The rotatable nozzle head seems to be effectively suspended in the drive shaft representing a considerably complication in the manufacturing as well as in the maintenance work on the unit. The turbine and the presence of the shaft together with the various bearings inside the flow conduit are bound to cause a pressure drop in the washing liquid representing an energy cost for the pumping and a loss of washing effectiveness. Variations in the pressure in the washing liquid fed to the apparatus will influence the speed of rotation and the range of speed variations possible by controlling the blade pitch angle in the tubine will be narrow.

Patent application GB 2 096 455 discloses a tank washing apparatus with a washing head arranged to be pivoted 360° about a vertical axis and an angle about a horizontal axis in order to allow the beam pattern to cover a spherical surface wherein the washing head is rotated about the vertical axis driven by a shaft arranged centrally inside the support pipe and wherein the rotatable washing unit includes means for causing the nozzle to pivot in a small increment about the horizontal axis by each revolution about the vertical axis.

The rotation is driven by means of a turbine rotated by the washing medium, the turbine driving a hydraulic pump connected by hydraulic connection lines to a hydraulic motor geared to drive the shaft. A lead screw mechanism is driven by the shaft and fitted with nuts which operate a hydraulic reversal valve in order to ensure the automatic reversal of the rotation.

This apparatus is quite complicated in including numerous small parts, bearings and seals, many of which are in contact with the washing medium and many of which will give rise to a pressure drop in the washing medium.

With a mechanism of a type wherein the orientation of the nozzle describes a helical movement pattern with parallel tracks disposed at completely identical intervals as seen on a spherical shell and wherein the speed of rotation about the vertical axis is constant, the beam ejection intensities are not identical in all directions. The nozzle allocates equal periods of time to angular paths of equal angular extent relative to the vertical axis. However, these angular paths correspond to solid angles of different sizes extending from small circles about the polar directions and to an expanded band around the equatorial plane. This heterogeneity may also be expressed in the angular velocity of the nozzle movement which approaches the angular velocity of the movement about the horizontal axis when close to the polar directions, whereas in the equatorial plane it is a vector sum of this velocity plus the angular velocity in the movement about the vertical axis. Therefore, a mechanism of this kind rotating at constant speed about the vertical axis will produce a beam pattern which is symmetrical about the vertical axis and wherein the intensity is higher in the axial directions than in the directions perpendicular to the axis.

In addition to being decisive for the intensity with which a given stretch or surface is swept, the angular velocity is of particular importance to the operational range obtainable with a washing nozzle. The liquid molecules which are ejected from the nozzles at a suitably high velocity will be slowed down when they strike on stagnant air. Thus, the ejection length obtained with a nozzle is most far reaching when the nozzle is set in a fixed direction thereby providing a liquid beam which continuously accelerates the air in an area around the beam path whereas the operational range of the beam drops if the nozzle is swept during washing because the liquid molecules in the front side of the beam will be slowed due to the air resistance.

It is considered realistic to obtain an effective cleaning effect at a distance of e.g. 25–30 meters from the nozzle outlet at an operational nozzle pressure of a magnitude of 12 bar and with the use of a suitably large nozzle, where the throughput amounts to 50–100 $m^3$ per hour. However, this presupposes that the nozzle does not move or pivots only very slowly, the maximum allowable velocity being empirically expressed by a maximum travelling velocity of the beam's impingement area on a value comprised within the interval of 0.5–1.5 meter per second. If the velocity increases substantially beyond this limit, the beam loses its momentum by the slowing effect of the air, and it is scattered without obtaining said operational range. Although it is conceivable that the beam's impulse may be enhanced to increase the operational range by applying a higher operational pressure, increased volume throughput, etc., it will be understood that in case of ejection lengths of a magnitude of 25 meters, the air resistance will in any case severely restrict the sweep velocity of the beam.

Practice has established the need for cleaning tanks of particular configurations and with particular cleaning needs wherein the most desirable beam pattern is very different from the one which may be produced with the known washing heads. This applies to e.g. tanks where the roof is displaced vertically, e.g. the socalled floating-roof tanks where the roof floats on top of an enclosed amount of liquid during the normal use of the tank, and where the roof drops to a bottom position when the tank is emptied with a view to cleaning. In the bottom position, the roof is supported by supporting legs which serve to keep it in such a position that it is possible for the service personnel to enter the tank.

This constructive principle is employed e.g. in cylindrical tanks for the storage of oil where the tank diameter may be from 40 to 50 meters, occasionally as wide as 80 meters. In the empty tank the internal height above floor is typically from 1.8 to 2.3 meters. If the tank has a diameter of 50 meters it will be possible to sweep the entire tank floor where the most heavy impurities are located from a position at the tank centre provided that a washing nozzle having an operational range of 25 meters is employed.

Of course the nozzle will have to be arranged below the tank roof and the nozzle will have to be pivoted within a solid angle corresponding largely to a semisphere or a semispace below the nozzle whereby the entire floor area is covered. However, the intensity should not be the same in all directions from the nozzle within this semispace. On the exemplary assumption that the floor is to be cleaned by means of a nozzle located at a height of 1.5 meters above the tank floor, it may be calculated that within a nozzle angle of from 0 to 30° from the vertical line, a subtending circle having a radius of about 0.9 meters and an area of 2.4 $m^2$ would be covered, from 30 to 60° a subtending circular belt towards a radius of 2.6 meters would be covered, the belt area being 18.6 $m^2$, and from 60 to 90° angle (it is assumed here that at 90° the beam only just deflects and impinges the floor 25 meters from the nozzle), a subtending circular belt extending to a radius of 25 meters would be covered where the belt area is about 2,000 $m^2$.

An apparatus producing a helical pattern and sweeping with constant speed about the vertical axis and with a constant speed about the horizontal axis will distribute even amounts of washing intensity to each of said three areas. If washing time is selected to produce the required dose of treatment in the outermost areas, it is estimated that the treatment dosage will be in the order of 100 times greater in the intermediate area and in the order of 1,000 times greater in the innermost area.

SUMMARY OF THE INVENTION

The invention in one aspect provides a method of washing a surface inside a tank, comprising arranging a washing head in a fixed position inside said tank, which washing head supports a nozzle holder fitted with a nozzle, adapted for ejecting a beam of washing fluid, which nozzle holder supports said nozzle rotatable about a first axis and a second axis, said second axis being oriented substantially perpendicular to said first axis; surveying the surface to be treated by said beam in order to effect the washing, estimating corresponding angular orientations of said nozzle, estimating required dosage levels of beam treatment in respect of selected different zones of said surface; carrying out a washing operation by forcing washing fluid to be ejected through said nozzle while rotating said nozzle holder about said axes in such way that for a full revolution about said first axis said nozzle holder performs an incremental rotational movement about said second axis, until said nozzle has traced a path, by which said beam has scanned generally all of said surface; monitoring during said washing operation the nozzle holder angular movement along said path; and controlling during said washing operation the intensity of beam treatment based on the result of said monitoring in order to adapt it to the respective dosage levels estimated to be required for respective zones.

This method enables more effective cleaning of large areas of many different configurations than obtained with the prior art, i.e. cleaning at reduced energy consumption, reduced washing fluid consumption, reduced costs of reprocessing or disposal of waste liquid and reduced time consumption. Moreover, excess wear on the tank surfaces is avoided since the extent of redundant washing may be reduced.

The divergence of the washing beam designates the beam spread. This spread may not be defined mathematically in concise terms but may be defined empirically by observing the width of the field in which the beam can be considered to perform effective cleaning. The divergence is an angle defined by the width of the cleaned field projected onto a plane perpendicular to the beam orientation and divided by the distance between the nozzle and the impingement site. A small divergence is a spread which is so narrow that it is necessary to orient the nozzle towards the place to be cleaned and to sweep it during washing to obtain a cleaning effect extending over an area of practical relevance.

In practice the beam will not be sharply delimited and its cleaning effect will vary from its centre towards the edges of the exposed section. The width of the cleaned field may even vary as a consequence of many factors, such as the nature of the soiling, the character of the beam's cleaning effect which may in turn rely on a number of factors depending on the particular task to be performed, such as impingement impulse, heating effect, dissolving effect, etc. The determination of the divergence must thus necessarily rely on a concrete estimate as is the case with the cleaning result. The divergence may e.g. be determined as the largest distance between two parallel sweep paths of the washing beam where the cleaning effect just has a satisfactory uniformity throughout the area between the two paths. If the rotation about the second axis per revolution about the first axis corresponds to the divergence, a continuous pivoting about the first axis thus results in coverage of a continuous surface. If the revolution about the second axis is faster than that, coverage of a coherent surface may be obtained by building a pattern of repeated, phase-shifted sweeps of the surface. If such pattern with a certain beam divergence covers a coherent solid angle, i.e. a continuous surface on a sphere shell with the nozzle at its centre, it is assumed that a corresponding, coherent surface may be determined on the interior of the tank being treated. If the tank contains baffling elements, a dedicated assessment of any surfaces in the shade must be performed.

To solve a given cleaning task the geometry of the surface to be cleaned is surveyed and the corresponding solid angles which are to be covered by the washing beam are determined on the basis of the selected position of the washing head. Different points on the surface to be treated may not be impinged in exactly identical manner by the washing jet, first and foremost due to the different distances and the different approach angles. Different surfaces may moreover be soiled to different degrees thus not requiring the same degree of cleaning. For a number of representative points on the surfaces to be treated, the geometrical efficiencies and the desired intensities expressed by a suitable criterium are assessed. The criterium may e.g. indicate the relative dosage of washing fluid required per area unit or the like. The appropriate dosage per area unit may be established experimentally.

During a washing procedure when the beam is to reach very far, the exemplary empirical criterium may be used that the impingement area of the beam must not travel faster than a given velocity, e.g. comprised within the interval of 0.5–1.5 meter/second along the cleaned surface. For the sake of evaluating the geometry of the nozzle sweep pattern, the dosage needs only be known in relative terms. A criterion relating to dosage/square unit may be converted to a criterion relating to intensity, such as beam travelling velocity on the surface, which may be converted to be expressed in terms of allowable maximum angular velocity in the pivoting movements of the washing nozzle. This expression is convenient in case of a nozzle operating on constant fluid pressure and pivoted with a controlled rotational speed. Other expressions may be preferred for other set-ups, e.g. in case a nozzle is operated on a controlled fluid pressure and rotated at a constant speed, it might be more convenient to express the criterion in terms of fluid presure.

Those sections within the total cleaning area which require the lowest angular velocities of the nozzle's pivoting movements are designated the dimensioning zones. Since they will normally correspond directly to the remotest zones to be covered by the washing beam or optionally to the areas where a particularly high degree of soiling is expected, it will normally not be difficult to predict which zones will be the dimensioning zones.

The washing head will be oriented, i.e. set in accordance with the invention, in such a manner that the first axis is oriented so that the dimensioning zones exhibit the highest possible degree of rotational symmetry about the first axis. This means that the washing head will be able to scan these zones with one or more revolutions about the first axis at a substantially constant velocity, and subsequently to move on to areas which may be scanned at a higher rotational velocity. In this way the rotational symmetry is exploited in the areas to be cleaned in such a manner that the rotational velocity of the washing head is only to be changed slowly in pace with its movement towards other zones. This makes it possible to adapt the mechanism for control of the pivoting velocity in a comparatively simple manner.

If the rotational symmetry about the first axis is perfect, optimum efficiency may be obtained in this manner. If the rotational symmetry is imperfect, the rotational velocity must be set in accordance with the directions which require the lowest angular velocities, and this may result in other directions on the same circular path being washed with a slower pivoting movement than was strictly necessary.

For the areas to be scanned at a higher pivoting velocity, an estimate is made of the maximum allowable pivoting velocity about the first axis for each pivoting direction about the second axis. In the course of carrying out a washing operation, the nozzle holder angular movement is monitored and the intensity of beam treatment is controlled in accordance with the estimate of maximum allowable pivoting velocity in respect of the prevailing pivoting direction. Hereby the pivoting velocity is controlled to be kept as high as possible everywhere. Since the allowable rotational velocity may differ widely (cf. the example of a factor 1.000), it may occur that the allowed rotational velocity exceeds that velocity at which the drive mechanism is acutally able to pivot the nozzle, and therefore a certain excess dosing may occur in such areas. However, the degree of adaptation to the optimum beam pattern which is obtainable according to the invention is considered to be far superior to the one obtainable according to the prior art.

If the area to be washed is a planar tank floor, a perfect rotational symmetry of the desired washing pattern is obtained by orienting the first axis perpendicular to the tank floor. In this case the dimensioning zone is comprised of the most remote areas to be washed, i.e. the most slow pivoting about the first axis is to be performed with a nozzle orientation which is approximately horizontal. In case of a spherical tank, the washing head may be arranged at the centre whereby a rotational symmetry for each orientation is obtained, or the washing head may be so arranged as to be displaced relative to the tank centre whereby the desired symmetry is obtained by orienting the washing head with the first axis parallel with a line through the tank centre.

The invention also permits very convenient treatment of tanks of completely different configurations, e.g an elongated tank may be treated wherein the washing head may be arranged centrally with the first axis in the longitudinal orientation of the tank. In this case it is conceivable that the dimensioning zones could be the zones immediately adjacent the two longitudinal directions.

Control of the pivoting movements about the first and the second axes, respectively, may be provided e.g. by mechanical gearing with a suitable gear ratio or e.g. by mutually independent drive motors where the drive associated with the second axis is activated to pivot the nozzle at the predetermined angular increment once per revolution about the first axis.

According to a preferred embodiment the nozzle path is so determined that it follows a helical track with a substantially constant angular pitch. Hereby a uniform coverage of the entire area to be swept is ensured without overlapping, and the desired angular space is covered with the slowest possible pivoting movement of the nozzle.

According to a preferred embodiment of the invention the path is defined as a closed loop essentially comprising four legs; a first leg forming a helix with constant angular pitch, traversed by the nozzle while rotating about the first axis; a second leg forming a half-circle, traversed by the nozzle upon reversal of the rotation about the first axis; a third leg forming a helix similar to the first leg helix but shifted a half revolution about the first axis, traversed by the nozzle while rotating about the first axis; and a fourth leg formed as a half-circle, traversed by the nozzle upon a second reversal of the rotation and taking the nozzle back to its starting point. This movement may be produced by simple mechanical means, and it ensures a perfect coverage of the area to be impinged. The double-helix principle has a good cleaning effect and a good washing-away effect on the impurities due to the partial occurrence of repeated treatment of the area. Moreover, when hot liquid is used for the washing to effect heating, a more gradually distributed heating of the surfaces is obtained which is advantageous with regard to the thermal tensions that may occur.

According to a preferred embodiment the nozzle velocity is controlled in accordance with a curve defined in accordance with the energy density desired in different zones defined by the pivoting angle at the nozzle about the second axis. Since this control needs not take into account pivoting movement of the nozzle about the first axis, a simple control manner is obtained which may produce almost any characteristics which only have to meet the restriction that they should be rotationally symmetrical about the first axis.

The invention in a further aspect provides an apparatus for washing a surface inside a tank, comprising a support pipe, a washing head supported by said pipe to be rotatable about a first axis, a first angular drive means for controlling the rotation of said washing head about said first axis, a nozzle holder supported by said washing head so as to be rotatable about a second axis which extends generally perpendicular to said first axis, a second angular drive means for controlling the rotation of said nozzle holder about said second axis, and a nozzle fixedly supported by said nozzle holder, said support pipe, said washing head, said nozzle holder, and said nozzle being adapted for providing a sealed flow conduit adapted for conveying washing fluid introduced into said support pipe to be ejected through said nozzle, said second angular drive means comprising a worm gear arranged coaxial with said first axis and a toothed segment arranged coaxial with said second axis and fixedly connected with said nozzle holder, and in tooth meshing engagement with said worm gear, said worm gear and said toothed segment being adapted to effect by rotation of said washing head about said first axis a coupled rotation of said nozzle holder about said second axis at a reduced speed, said first angular drive means comprising a gear externally of said washing head.

This provides a comparatively simple and very reliable apparatus capable of achieving a great operating range and exhibiting advantages corresponding to those obtained with the method referred to above.

In the apparatus according to the invention the flow conduit communicating the washing liquid is adapted to permit a flow practically unhindered by obstacles and with as few changes of direction as possible thereby minimizing the pressure loss in the apparatus and ensuring the maximum effect in the washing. All bearings associated with the rotation about the vertical axis are separated from the washing liquid by seals preventing premature wear and corrosion of these critical parts. Assembly and maintenance works are particularly simple. For instance the motor unit may be dismantled while the rotatable head is left in place or vice versa. Manufacture and assembly of these parts are not particularly critical, the driving gear engagement between the motor drive and the rotatable head being capable of accomodating substantial axial tolerances. The parts of the apparatus have comparatively simple forms, are comparatively easy to manufacture, and the number of parts is substantially smaller compared to the prior art. The apparatus of the invention also lends itself to variation, e.g. fitting of different types of motor drive, different gear ratios, etc.

According to a preferred embodiment the apparatus comprises a programmable functional curve which defines the energy density as a function of the nozzle holder rotation, said functional curve being provided to compensate for geometrical and flow-dynamic conditions for the washing, so as to provide as uniform a coverage as possible of the surface to be washed. The geometrical and flow-dynamic conditions relate to e.g. washing distance and the character of the washing beam, its approach angle on the impingement site, its way of influencing the soiling, etc. These conditions may to some extent be predicted in advance by theoretical considerations about the geometry, but such conditions may also be included which can only be determined empirically and which may be converted into correction factors which may be entered in the functional curve.

According to a preferred embodiment of the invention the apparatus comprises removable gears for the coupling of the rotation movements about the first and the second axes, respectively. This makes it possible to change the gear ratio in order to implement different path spacings in the washing movements, e.g. in order to adapt the apparatus to optimal utilization of different effective divergences.

According to a preferred embodiment the pivoting movement is driven by a power supply where the power supply and any power transmission means are arranged outside the flow of pressurised washing agent. This makes it possible to protect the power supply and any power transmission means against undesired deteriorating influences from the washing agent, and the operation may be controlled independently of the pressure in the washing agent.

Further features and advantages of the invention will appear from the following detailed description of preferred embodiments which is given with reference to the drawings.

BRIEF DESCRIPTION OF THE DRAWINGS

FIG. 6 is a vertical sectional view of the washing head shown in FIG. 4, seen perpendicular to the view shown in FIG. 4, and FIG. 7 is a planar view of the washing unit shown in FIG. 4.

DESCRIPTION OF THE PREFERRED EMBODIMENTS

All figures are schematical and not necessarily to scale, and they illustrate only the details necessary for the understanding of the invention while other details have been omitted for the sake of clarity. In all Fig.s the same references are used to designate identical or corresponding items.

Figure 1:
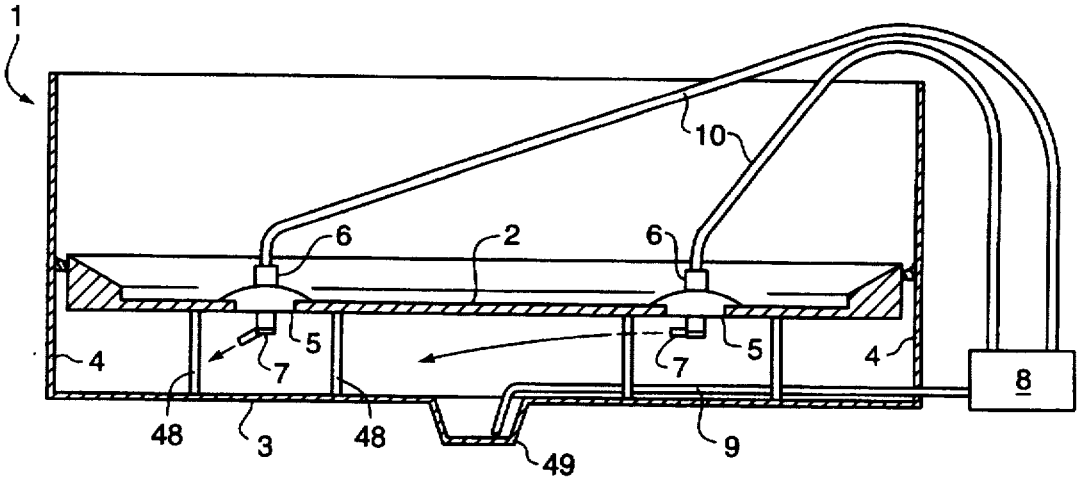
FIG. 1 is a vertical sectional view through a tank in which the apparatus according to the invention is mounted.
Figure 2:
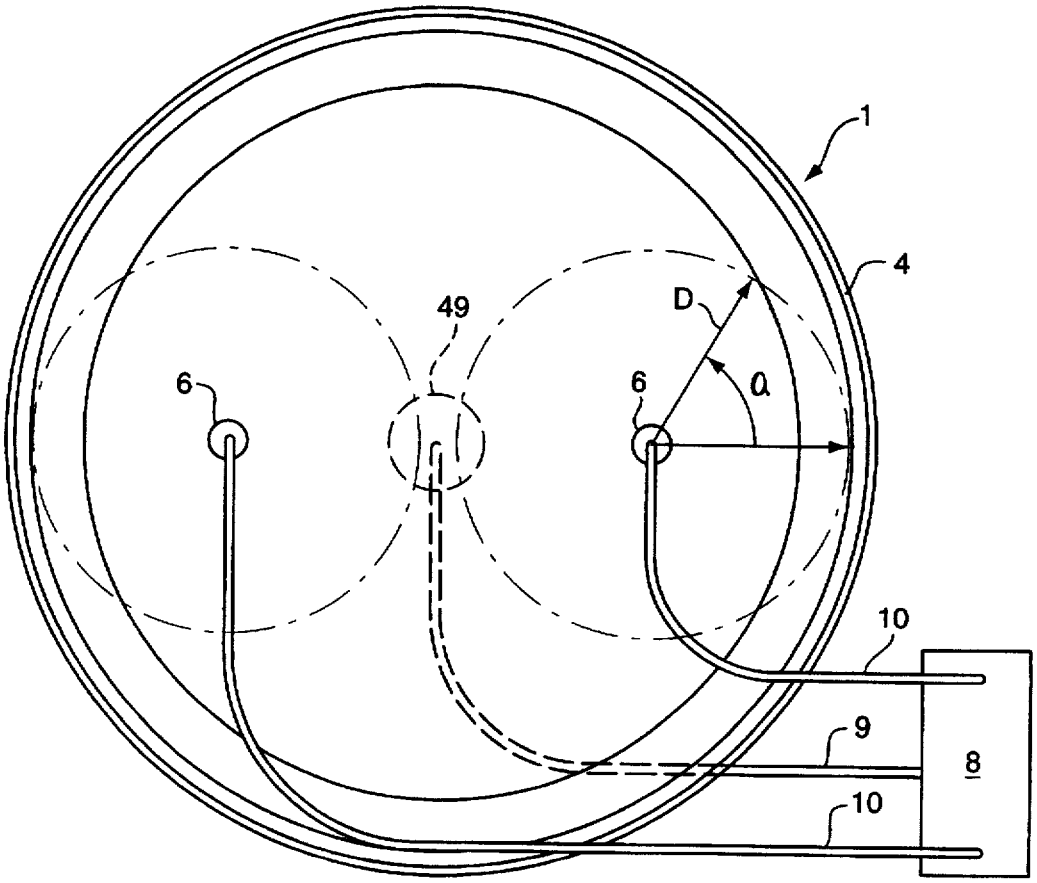
FIG. 2 is a planar sectional view through the installation shown in FIG. 1 along the line II—II.

Reference is first made to FIGS. 1 and 2 which schematically illustrate the situation during cleaning of a tank. The tank 1 illustrated herein is of a type which may be used e.g. for the storage of oil. It comprises a horizontal roof 2, a horizontal tank floor 3 and a vertical cylindrical tank wall 4. The roof 2 of the tank shown is constructed to be able to float on top of the body of oil stored in the tank, so that substantially no air is trapped below the roof. When the tank is emptied the roof will follow the change in the oil level downwards until it engages the support legs 48 which serve to support the tank roof at such height that service personnel may in a reasonably convenient manner move about inside the tank. The free height inside the tank usually ranges within the interval of from 1.8 to 2.3 meters. The tank diameter may be from 10 to 80 meters and typically about 40–60 meters.

During storage of oil products there is a tendency that comparatively heavy, tar-like substances, rust, pitch, wax and sand which do not readily float, will sediment on the tank floor. With time, the sedimentations will form an undesired layer which may assume a considerable thickness, and therefore it will at intervals be necessary to wash the floor with a suitable washing liquid intended to dissolve the layer in order to facilitate removal.

FIG. 1 illustrates an assembly wherein two washing units 6 are mounted in manholes 5 in the tank roof in such a manner that the positions they occupy allow them to wash the tank interior by means of pivotable nozzles. The washing units 6 are connected to a processing unit 8 by means of feeder hoses 10, and washing liquid with slurried or dissolved impurities are retrieved from the sump 49 at the bottom of the tank and conveyed through the draining hose 9 to the processing unit. The processing unit 8 comprises means, such as a reservoir and suitable pumps, for conveying washing liquid under pressure and means, such as filters, cleaning means and reservoirs, for treating the washing liquid discharged from the tank. The processing unit 8 may e.g. be in the form of the unit described in the above-mentioned U.S. Pat. No. 5,591,272 and intended for utilising recycled liquid in the washing following cleaning and heating which is convenient in case of sediments that may be softened or dissolved by heating. The feeder hoses 10 include pressure hoses for the washing liquid and cables permitting powering and control of the pivoting movement of the washing unit nozzles thereby allowing these movements to be powered and controlled by the processing unit 8.

FIGS. 1 and 2 show two washing units mounted in a tank. It will be understood that depending on the effective operational range obtained with the washing nozzle and on the tank size and shape, a large or small number of washing units will be arranged therein and distributed in such a manner that the entire tank floor may be covered.

Figure 3:
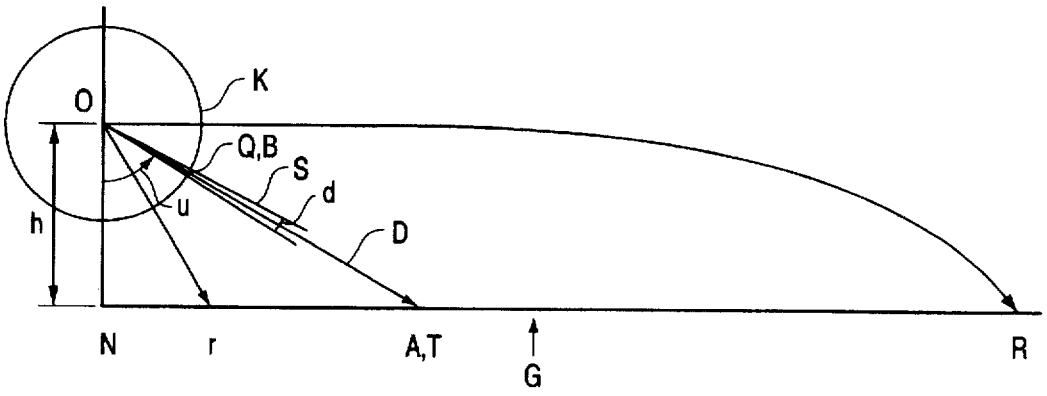
FIG. 3 is a geometrical schematic diagram.

Reference is now made to FIG. 3 for an explanation of the geometry of the ejection and the designations used in that context. FIG. 3 represents a schematical, vertical, sectional view wherein the pivotable nozzle is arranged in the point O (for Origo), and wherein the section follows a vertical plane through O and includes the range from O and outwards to the right approximately to the maximum effective operational range of the nozzle. The floor to be washed is indicated by the line G at the bottom of FIG. 3. The point vertically below O is designated N (for Nadir), and the nozzle aiming direction is indicated by the vector D.

The inclination of the nozzle direction is expressed by the elevational angle u which is measured from the vertical line through N and upwards. The direction vertically downwards is designated elevational angle or height 0° and horizontal ejection is designated elevational angle 90°. The nozzle also has a degree of freedom to pivot or swivel about the axis ON. The rotation about this axis is referred to as the azimut-movement and it is described by the angle a referred from an arbitrarily chosen, horizontal direction as shown in FIG. 2. The nozzle aiming direction D may describe any point on the unitsphere K with its centre in O since the azimut-angle may traverse the entire interval from 0 to 360°, and the elevational angle u the interval from 0 to 180°.

The washing beam S is ejected in such a manner that its axis follows the nozzle aiming direction D. The beam has a limited width expressed by the angle of divergence d, defined empirically as mentioned above. In case of short distances the washing beam S may be expected to follow an approximately linear course while in case of large distances, it will be subject to deflection relative to the nozzle direction D, due to the influence of gravity. For a given height of the washing head above the floor h and for a given washing beam, an upper limit exists for how far from the washing head cleaning may be obtained, expressed by the operational range R measured from N. The widest operational range is obtained with a nozzle direction D somewhat above horizontal, e.g. with an angle of elevation within the interval 90–110°, where the optimum angle may be established empirically.

The nozzle direction D intersects the unitsphere in the point Q and the pattern of the washing nozzle movement may be described by the path B traced by Q on the unitsphere during the pivoting movement. The washing beam S impinges the floor G over a diffused area whose core point is designated the impingement point A. The distance of the impingement point from N is designated r (for radius). By pivoting the washing nozzle, the point A describes a trajectory T on the floor while Q describes the path B on the unitsphere.

The washing intensity desired on the floor may be converted into intensities desired in different angular sectors by means of estimation calculations. For instance, one empirical rule dictates that the washing beam must move across the floor in such a manner that the impingement point A moves at a velocity of no more than 1.5 meter per second. If the operational range R is 25 meters it follows that the washing beam may reach a corresponding circle on the floor with its centre in N, radius r=25 meters and with the periphery $2\pi\times25$ meters corresponding to 157 meters. This circle may be scanned through at the allowed velocity during a period of time which may be calculated by 157 divided by 1.5 corresponding to 105 secs. This may be obtained by allowing the washing head to perform a full revolution about the vertical axis in 105 seconds. During this operation, the elevational angle u is maintained constant or approximately constant in the direction which corresponds to the maximum operational range, e.g. an angle between 90 and 110°.

In case of a smaller circle, e.g. one having a radius of 10 meters, the periphery is 65 meters, and this circle will then be scanned at the allowed velocity of 1.5 meter per second by allowing the washing head to perform a full revolution about the vertical axis over a period of 43 secs. No account taken of the beam deflection, the corresponding angle u is 82°. A more accurate value of the corresponding elevational angle may be determined experimentally. In case of short distances the beam may be assumed to follow a linear course and the length of the periphery of the exposed area for a given value of the angle u may then generally be designated $h\cdot2\pi\cdot\tan u$ thereby allowing this expression to be used for the determination of the ideal velocity of the azimut-movement for any value of the angle u.

The adaptation of these geometrical analysis methods for use with tank surfaces of other configurations will be obvious to the person skilled in the art.

Figure 4:
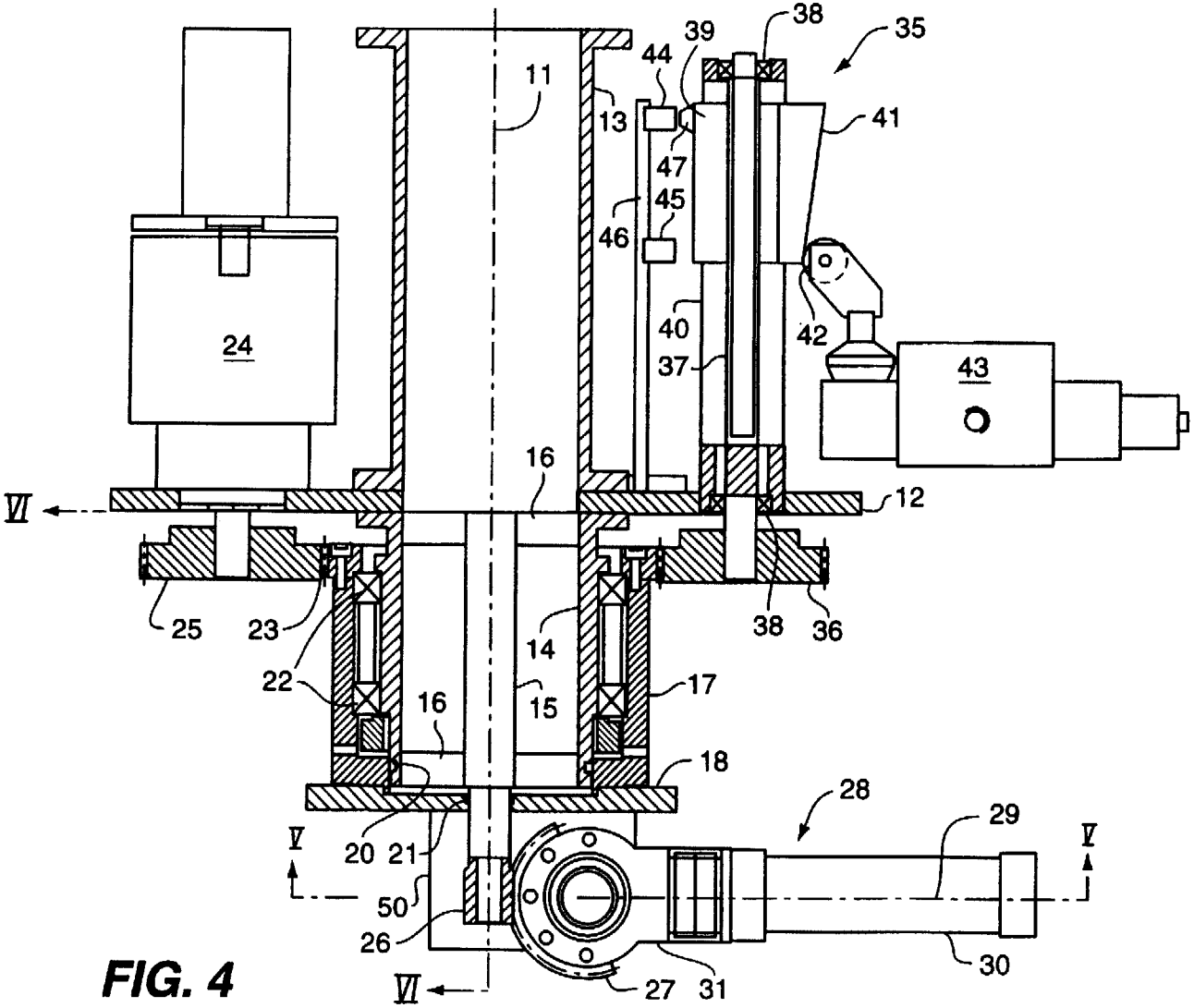
FIG. 4 is a vertical sectional view through a washing unit according to a first embodiment of the invention.

Reference is now made to FIG. 4 for a more detailed description of the washing unit 6 according to the invention. The washing unit 6 comprises a mounting flange 12 on which a connecting pipe 13 is arranged in such a manner that a pressure hose through which washing medium is supplied may conveniently be connected thereto. On the opposite side of the mounting flange 12 the washing head 7 proper is arranged, the washing head essentially consisting of a support pipe 14 fixedly connected to the flange 12, and a cup-like rotational sleeve 17 fitted about the support pipe and supported by bearings 22 that allow it to swivel about the support pipe 14 about an axis substantially perpendicular to the mounting flange. The corresponding rotational axis 11 is denominated the vertical axis or the first rotational axis.

A drive gear 23 is fixedly bolted onto the rotatable sleeve and meshed with the drive pinion 25 operated by the drive motor 24 shown to the left of FIG. 4. To the right in FIG. 4 the drive gear meshes with the monitor gear wheel 36. The rotatable sleeve 17 is closed at the bottom by a sealing bottom plate 18. The support pipe is provided with a seal 20, rotatably sealing the communication between the support pipe and the rotatable sleeve thereby rendering it proof to washing liquid contained under pressure. Concentrically with the vertical axis 11 a permanent centre spigot 15 is provided which projects through a corresponding opening in the bottom plate 18, a seal 21 being arranged on said centre spigot to seal the rotatable gap. The centre spigot 15 is supported relative to the support pipe 14 by spokes 16. The lowermost portion of the centre spigot 15 protruding outside the seal 21 is provided with a worm gear 26 for engagement with a toothed segment 27 which will be explained in further detail below.

To the right of the connection pipe 13 in FIG. 4 the monitor unit 35 is illustrated whose main component is a spindle 37 mounted in spindle bearings 38 at the ends and in fixed engagement with the monitor gear wheel 36 which rotates the spindle. On the spindle a slide 39 is in threading engagement with the spindle and secured by slide guides 40 to prevent it from rotating thereby allowing it to be displaced axially on the spindle by rotation of the spindle.

The slide comprises a level curve 41 and a tab 47. The tab 47 may activate switches mounted on the vertical fixture 46 with the option of adjustment by vertical displacement. According to their use the switches are referred to as the upper end stop 44 and the lower end stop 45, respectively. The switches may comprise mechanical levers or they may be based on other principles, e.g. magnetic or optical principles as may be suggested by a person skilled in the art.

The level curve 41 is monitored by the cam follower 42 which is implemented as a small roller at the end of a lever biased to maintain the cam follower 42 in firm abutment on the level curve and which is associated with a detector 43 that may detect the extent of the cam follower's excursion.

According to a preferred embodiment of the invention, the detector comprises a control valve for hydraulic fluid, while the drive motor comprises a hydraulic motor, the rotational velocity of which may be varied by control of the hydraulic flow. In other embodiments other types of detectors and drive motors could be used which may be suggested by those skilled in the art, the essential point being that a monitoring is effected by the curve shape entered in the level curve and an intensity control provided on the basis of the information detected. Other embodiments may comprise programmable units where the slide movement is monitored and wherein the level curve may be replaced by e.g. a list of numerical values entered in a programmable electronic memory.

While in the preferred embodiment, the intensity is controlled by control of the rotational velocity in the hydraulic motor 24, it is also within the scope of the invention to control the washing intensity in other ways, e.g. by controlling the pressure and amount of washing medium or by employing other types of controllable drive motors.

Below the bottom plate 18 two connecting chambers 50 are mounted which will appear most clearly from FIG. 6 and the interiors of which are in flow communication with the support pipe 14 interior through respective flow openings 19 in the bottom plate (the openings will appear from FIGS. 6 and 5). The two chambers serve to hold the nozzle arm 28 in such a manner that it may pivot about the axis 34 designated the elevational axis or the second rotational axis. The nozzle arm 28 essentially consists of a nozzle pipe 30 having at its end an outflow opening which is symmetrical relative to the centerline 29 of the nozzle pipe, said pipe being arranged in a nozzle holder 31 having the approximate shape of a banjo connector i.e. a hollow component with transversal openings in flow communication with a longitudinal pipe to which the nozzle pipe 30 is connected.

The nozzle holder is mounted by means of nozzle holder bushings 32 in the connecting chambers in such a manner that the nozzle arm may pivot about the elevational axis and the nozzle holder as such is so designed that the center line 29 of the nozzle intersects the elevational axis as well as the vertical axis. This ensures that the reaction force developed by the ejected liquid beam will creat no net torque, which might otherwise affect the pivoting of the nozzle and strain the drive mechanism. The nozzle holder comprises seals 33 which ensure pressure-proof connection to the connecting chambers.

Figure 5:
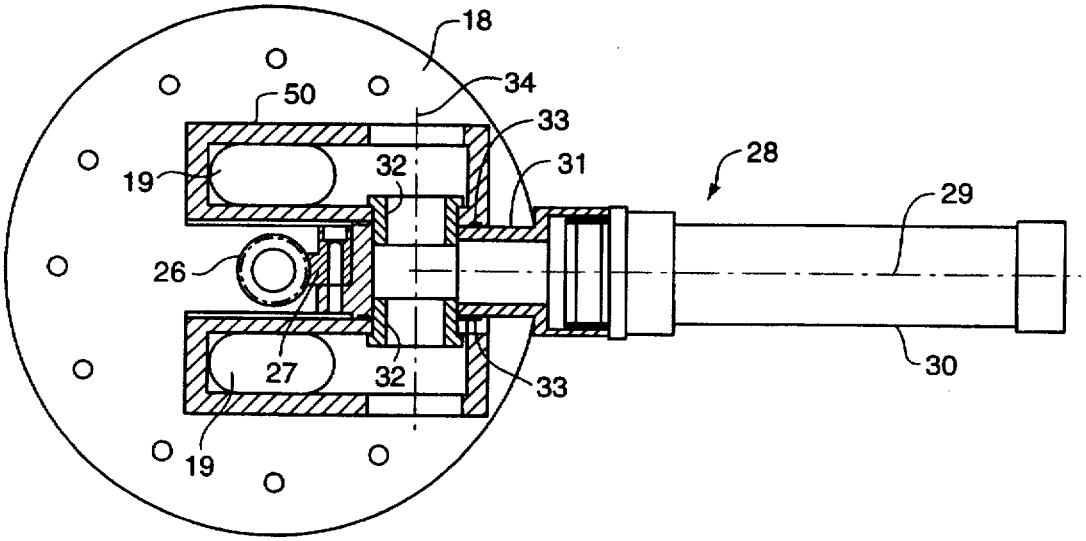
FIG. 5 is a horizontal sectional view along the line V—V shown in FIG. 4.

On the left portion of the nozzle holder as shown in FIG. 5 a toothed segment is seen which is mounted on the nozzle holder with screws or the like, centered about the elevational axis and in engagement with the worm gear 26 of the center spigot. This toothed segment and the worm gear are matched for mutual tooth meshing and according to the preferred embodiment adapted for a pitch equal to a rotating movement of the nozzle arm of 4° about the elevational axis for one full revolution (360°) about the vertical axis thus allowing the rotational sleeve 17 to perform e.g. 23 complete revolutions whereas the elevational angle performs only one quarter of a revolution. By the exemplary 23 revolutions a path is described on the unitsphere as explained above with reference to FIG. 3, which path is helical with a constant increment of 4° measured in the elevational orientation. Thereby, the degree of overlapping during the ejection becomes uniform over the entire exposed area.

In the preferred embodiment the worm gear and the toothed segment are designed to engage with a clearance corresponding to one half of the increment. This permits a helical track to be described at constant spacing by revolution of the motor in the one direction while reversal of the motor will result in a second helical track which will be situated in the midst of the interspacings of the first. Following renewed reversal the nozzle orientation reverts to the first curve. The two helices are connected by transition legs with constant elevational angles at each end.

The toothed segment is designed to subtend an angle corresponding to the specified pivotal range, i.e. the angular range through which the nozzle holder should be capable of oscillating. During operation the range scanned by the nozzle holder will be defined by the setting of the end stops 44 and 45 mentioned above. In the preferred embodiment the segment is designed to permit overrunning of the worm as might happen in case of a faulty setting of one of the end stops. Should the worm thus overrun the segment, the toothed meshing engagement will temporarily be lost, ensuring that the nozzle holder will not pivot any further regardless of the number of continued revolutions about the vertical axis. The rotatable sleeve 17 and the nozzle holder 31 are designed to allow a pivoting of the nozzle holder with no interfering parts sufficient for permitting the segment to be overrun by the worm at both ends, thereby ensuring that no damage can be caused to these parts in case the end stop control should fail or perform in an unintended manner.

FIG. 7 is a planar view of the washing unit wherein the contour of the flange 12, the connecting pipe 13, the central spigot 15 with the supporting spokes 16, the drive motor 24, as well as various elements of the monitor unit are clearly seen. In particular, FIG. 7 shows how the monitor unit slide guides 40 comprise two substantially planar parallel lateral walls while the slide 39 has corresponding surfaces whereby it is guided by the lateral guides in a non-rotatable manner. Finally FIG. 7 illustrates the location of the detector 43 and that of the fixture 46 supporting the end stops.

Figure 8:
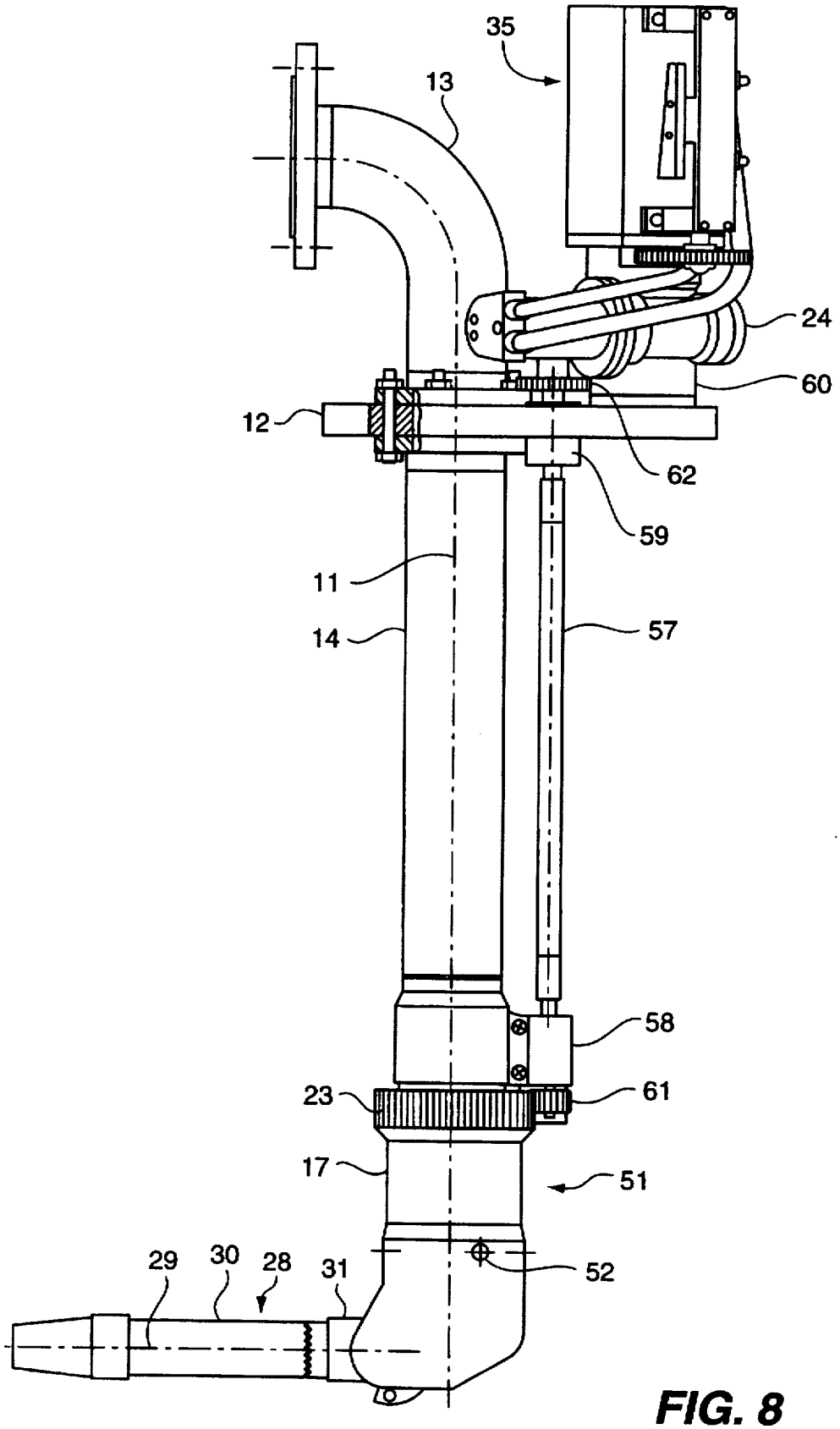
FIG. 8 is a vertical planar view of a washing unit according to a second embodiment of the invention.
Figure 9:
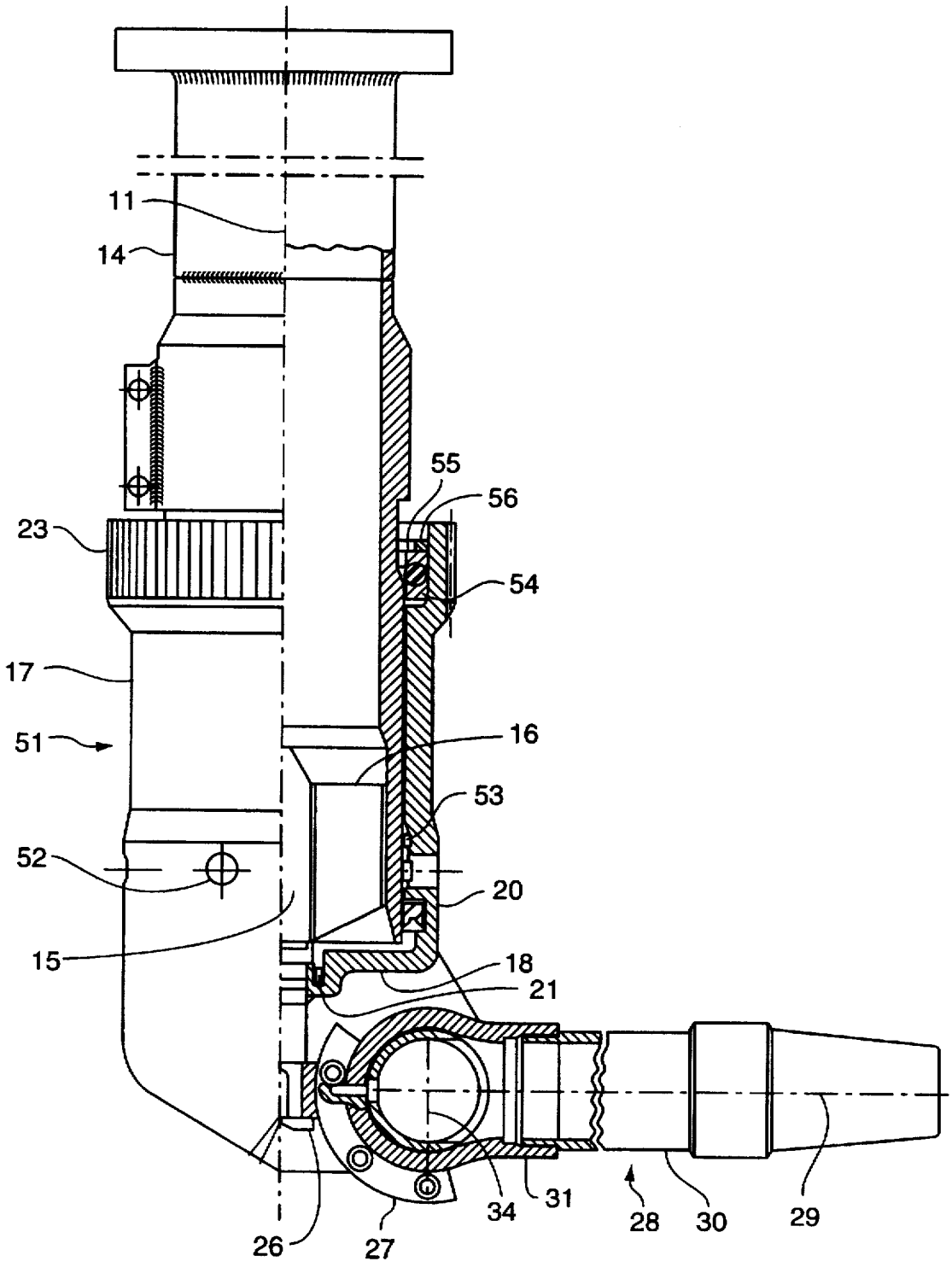
FIG. 9 is a vertical planar view of a portion of the washing unit of FIG. 8 shown partially in section and in enlarged scale.

Reference is now made to FIGS. 8 and 9 for a description of a second embodiment of the invention. The second embodiment is somewhat modified relative to the first embodiment and includes some parts which are different from those of the first embodiment, and other parts which are slightly modified relative to similar parts of the first embodiment and which are designated by the same references as the similar parts of the first embodiment.

Referring first to FIG. 8, the second embodiment of the invention is illustrated in a side view, the most significant differences from the first embodiment appearing to be that the support pipe 14 extends longer, that a separate drive shaft 57 is included, and that the drive motor 24 is arranged horizontally and combined with the monitor unit 35. The motor 24 and the monitor unit 35 are both connected to a gear box 60 in driving engagement with a drive shaft gear wheel 62 which drives the drive shaft 57 supported in drive shaft upper bearing 59 and drive shaft lower bearing 58. In its lower end, drive shaft 57 is connected to a pinion 61 in meshing engagement with the rotatable sleeve drive gear 23. The drive shaft lower bearing 58 is supported at the lower end of the support pipe 14. Further, FIG. 8 shows the modified rotatable head 51 provided with drain holes 52.

The rotatable head 51 is shown in greater detail and partially in section in FIG. 9. The rotatable head 51 includes an essentially cup-like rotatable sleeve 17, snuggly fitting for rotation about and rotatably supported by the outside of the lower portion of the support pipe 14. The rotatable head 17 is supported axially by axial bearing 55 engaged by a support pipe circlip 54 and a rotatable head circlip 56. A seal 20 keeps the washing liquid away from the parts of the rotatable head and the support pipe in sliding engagement. The rotatable sleeve also seats an additional seal 53 placed above the seal 20, the rotatable sleeve including between these seals a peripheral groove on the inside in communication with drainholes 52 arranged to relieve any pressure built up in this zone. The seal 53 serves to keep any lubricant or oil in place between the sliding surface. FIG. 9 also shows the nozzle 28, the worm gear 26 on central spigot 15 and other parts equivalent to the parts of the first embodiment so that reference may be made to the above given explanation of the first embodiment.

Although specific elements have been described above in specific contexts, such elements are not excluded from use in other contexts, from combination in other ways, and for being independently patentable. The preceding description serves only to illustrate the invention and it is not to be considered limiting to its scope which is exclusively defined by the appended claims.

I claim:

1. A method of washing a surface inside a tank, comprising:

arranging a washing head in a fixed position inside said tank, which washing head supports a nozzle holder fitted with a nozzle, adapted for ejecting a beam of washing fluid, which nozzle holder supports said nozzle rotatable about a first axis and a second axis, said second axis being oriented substantially perpendicular to said first axis, surveying the surface to be treated by said beam in order to effect the washing, estimating corresponding angular orientations of said nozzle, estimating required dosage levels of beam treatment in respect of selected different zones of said surface, carrying out a washing operation by forcing washing fluid to be ejected through said nozzle while rotating said nozzle holder about said axes in such way that for a full revolution about said first axis said nozzle holder performs an incremental rotational movement about said second axis, until said nozzle has traced a path, by which said beam has scanned substantially all of said surface, monitoring during said washing operation the nozzle holder angular movement along said path, and controlling during said washing operation the intensity of beam treatment based on the result of said monitoring in order to adapt it to the respective dosage levels estimated to be required for respective zones.

2. The method according to claim 1, wherein said path is determined to trace a substantially helical track of constant pitch.

3. The method according to claim 2, wherein said incremental rotational movement about said second axis is selected in accordance with the effective divergence of said beam in such way, that consecutive tracks in said path are spaced apart, while said surface is treated substantially continuously without substantial overlapping.

4. The method according to claim 1, wherein said path is determined to trace a closed loop comprising essentially four legs, a first leg forming a helix with constant angular pitch, traversed by said nozzle holder while rotating about said first axis in a first direction, a second leg forming a half-circle, traversed by said nozzle holder while rotating about said first axis in a direction opposite to said first direction, a third leg forming a helix similar to the first leg helix but offset by a half revolution about said first axis, traversed by said nozzle holder while continuing the rotation about said first axis in the direction opposite to said first direction, and a fourth leg forming a half-circle, traversed by said nozzle holder while rotating again about said first axis in said first direction and taking said nozzle holder back to its starting point.

5. The method according to claim 1, wherein the controlling of beam treatment intensity is carried out by controlling the speed of washing head rotation.

6. The method according to claim 1, wherein the controlling of beam treatment intensity is carried out by controlling the forcing of washing fluid through said nozzle.

7. The method according to claim 5, wherein the washing head angular velocity is controlled in accordance with a program curve, which defines dosage levels in respect of rotation angles of said nozzle holder about said second axis.

8. The method according to claim 1, and adapted for the washing of a planar surface, wherein said washing head is oriented in such way that said first axis is substantially perpendicular to said planar surface.

* * * * *